US008138877B2

(12) United States Patent
Demolis et al.

(10) Patent No.: US 8,138,877 B2
(45) Date of Patent: Mar. 20, 2012

(54) MAGNETIC CIRCUIT WITH WOUND MAGNETIC CORE

(75) Inventors: Sylvain Demolis, Saint Germain sur Rhone (FR); Pierre Mariano Benedetti, Saint Andre de Boege (FR); Thierry Didier Chenavard, Reignier (FR)

(73) Assignee: Liaisons Electroniques-Mecaniques LEM SA, Plan-les-Ouates ( * ) Notice: Subject to any disclaimer, the term of this patent is extended or adjusted under 35 U.S.C. 154(b) by 158 days.

(21) Appl. No.: 12/660,210

(22) Filed: Feb. 23, 2010

(65) Prior Publication Data

US 2010/0265027 A1 Oct. 21, 2010

(30) Foreign Application Priority Data

Feb. 25, 2009 (EP) ..... 09153590

(51) Int. Cl.
*H01F 27/06* (2006.01)
*H01F 7/06* (2006.01)
*H01F 27/24* (2006.01)

(52) U.S. Cl. ..... 336/213; 336/216; 336/178; 29/602.1

(58) Field of Classification Search ..... 336/213, 336/178, 216, 217, 185
See application file for complete search history.

(56) References Cited

U.S. PATENT DOCUMENTS

| | | | | |
|---|---|---|---|---|
| 4,587,507 | A * | 5/1986 | Takayama et al. | 336/178 |
| 4,789,849 | A * | 12/1988 | Ballard et al. | 336/210 |
| 4,893,400 | A * | 1/1990 | Chenoweth | 29/606 |
| 5,441,783 | A * | 8/1995 | Silgailis et al. | 428/37 |
| 6,498,554 | B2 * | 12/2002 | Chow | 336/199 |
| 6,583,707 | B2 * | 6/2003 | Ngo et al. | 336/234 |
| 6,765,467 | B2 * | 7/2004 | Ngo et al. | 336/67 |
| 6,829,817 | B2 * | 12/2004 | Ngo et al. | 29/602.1 |
| 6,992,555 | B2 * | 1/2006 | Hasegawa et al. | 336/178 |
| 7,289,013 | B2 * | 10/2007 | Decristofaro et al. | 336/233 |
| 7,307,504 | B1 * | 12/2007 | Carlino et al. | 336/213 |
| 2002/0157239 | A1 * | 10/2002 | Ngo et al. | 29/606 |
| 2006/0176047 | A1 | 8/2006 | Lepine et al. | |

FOREIGN PATENT DOCUMENTS

| | | | |
|---|---|---|---|
| DE | 1 148 020 B | | 5/1963 |
| GB | 539093 | | 8/1941 |
| GB | 1464798 | | 2/1977 |
| JP | 358056307 A | * | 4/1983 |
| JP | 2601297 | | 11/1999 |

* cited by examiner

*Primary Examiner* — Anh Mai
(74) *Attorney, Agent, or Firm* — Faegre Baker Daniels LLP

(57) ABSTRACT

Magnetic circuit comprising a gap bridging element made of a non-magnetic metal and a wound magnetic core comprising a plurality of stacked concentric ring layers of magnetic material having a high magnetic permeability. The magnetic core has a gap extending through a section of the stacked concentric ring layers of magnetic material, wherein the bridging element is welded to a lateral face of the wound magnetic core on either side of the gap. Welding connections between the bridging element and the magnetic core extend across the stacked concentric ring layers.

15 Claims, 2 Drawing Sheets

MAGNETIC CIRCUIT WITH WOUND MAGNETIC CORE

BACKGROUND

The present invention relates to a magnetic circuit with a magnetic core formed by winding a band or strip of highly permeable magnetic material, the wound magnetic core having an air-gap. The invention in particular relates to a magnetic circuit with wound magnetic core for an electrical current sensing device.

Many conventional current sensors comprise a magnetic core made of material with a high magnetic permeability and a magnetic field sensor, such as a Hall effect sensor, positioned in a gap formed in the magnetic core. A primary conductor extending through a central passage of the magnetic circuit generates a magnetic field that is picked-up by the magnetic core. The magnetic field flows across the gap and the magnetic field detector positioned therein. Since the gap represents a zone of low magnetic permeability and thus has an important effect on the magnetic field lines, it is important to accurately control the width of the gap in order to ensure accurate and reliable measurement of the electrical current to be measured.

It is also important to reduce losses in the sensor, in particular losses due to the formation of Eddy currents in the magnetic core and to avoid magnetic saturation along any section of the magnetic core. The use of stacked laminated sheets to reduce Eddy currents is well-known. A known means of forming a stacked multi layer magnetic circuit is by winding a thin band or strip of magnetic material to form an annular wound core. It is known to provide wound cores with air gaps, whereby the manufacturing process consists of first winding an annular toroidal core, subsequently applying resin around the core to hold the concentric layers of strip material and subsequently machining a gap radially through a section of the winding. Once the resin has been applied, annealing of the material of the wound magnetic core is difficult or no longer possible in view of the high temperatures required for the annealing process.

Working of materials with high magnetic permeabilities can affect their magnetic properties, in particular by reducing their magnetic permeability and thus adversely affecting the magnetic performance of the magnetic circuit.

The gap length of a magnetic circuit may vary due to thermal and mechanical forces. It is known to stabilize the size of the gap by means of an element fixed to the magnetic core. In JP 2 601 297 the air gap of an annular wound magnetic core is fixed by means of a T-shaped element having a portion partially inserted in the air gap from the outer radial side of the magnetic circuit, the insert being held in place by means of a band wound around the magnetic circuit and the insert. A drawback of this design is that the insert partially engages in the air gap and thus limits the space for insertion of a magnetic field sensor. Moreover, the insert only engages the outer peripheral layers of the magnetic circuit and thus does not prevent variation of the size of the air gap of the inner radial layers of the magnetic circuit, in particular variations due to thermal forces that the resin binding the layers cannot entirely prevent. Also, heat treatment of the magnetic circuit after application of the resin is either not possible or at best limited. The position of the insert from the outer radial periphery of the magnetic circuit also increases the size of the magnetic circuit.

In U.S. 2006/176047, a magnetic circuit with a bridging element welded either side of the air gap is disclosed. The magnetic circuit is however not multilayer and the bridging element welded either side of the air gap is positioned on the outer radial periphery of the magnetic coil and would not be appropriate for a conventional wound magnetic core.

It is an object of this invention to provide a magnetic circuit having a wound magnetic core with gap, that ensures accurate and reliable performance for current sensing applications, and that is economical to manufacture.

It would be an advantage to provide a magnetic circuit having a wound magnetic core with gap that is resistant to mechanical and thermal stresses.

It would be advantageous to provide a magnetic circuit having a wound magnetic core with gap that has uniform magnetic material properties, in particular a high and uniform magnetic permeability.

It is an object of this invention to provide a process for manufacturing a magnetic circuit having a wound magnetic core with gap, that is economical and results in a magnetic core that performs accurately and reliably for current sensing applications, and that is robust and resistant to thermal and mechanical stresses.

It would be advantageous to provide a wound magnetic core with gap that is compact and enables easy and versatile assembly of a magnetic field detector in the gap.

SUMMARY

Objects of this invention have been achieved by providing a magnetic circuit having a wound magnetic core with gap, the wound magnetic core comprising a plurality of stacked concentric ring layers of magnetic material having a high magnetic permeability, the magnetic core having a radial gap extending through a section of the stacked concentric ring layers of magnetic material, the magnetic circuit further comprising a gap bridging element, wherein the bridging element is made of a non-magnetic metal and is welded to the core either side of the gap, the welding connection between the bridging element and the core extending across the concentric ring layers from a radially innermost ring layer to a radially outermost ring layer.

The bridging element may advantageously be formed from an essentially flat sheet of metal, preferably by die stamping and forming out of sheet metal.

In an embodiment, the bridging element preferably extends either side of the gap along the core by an angle of over 30 degrees or more, advantageously by an angle of over 90 degrees either side of the gap, and comprises at least a second pair of weld connections to the stacked ring layers of the magnetic core proximate extremities of the bridging element. The magnetic circuit may comprise either side of the air gap along the bridging element a third pair or more of welding connections between the bridging element and stacked concentric ring layers of the core. Advantageously, the weld connections proximate the gap serve to stabilize and fix the gap size (i.e. distance between opposed faces of the magnetic circuit forming the gap). The weld connections proximate the extremities of the bridging element serve to hold the stacked ring layers together to prevent radial separation of the layer when subject to thermal or mechanical stresses. Intermediate (third and further) weld connections may be provided along the bridging element to further stabilize the concentric ring layers of the magnetic core and the attachment of the bridging element to the magnetic core. The bridging element may optionally and advantageously be provided with fixing elements, for example in the form of fixing pins or tabs bent out of the plane of sheet metal from which the support element is stamped and formed, for mechanical and/or electrical connection of the magnetic circuit to a circuit board or other circuit device.

Advantageously, the magnetic circuit according to the invention may be made without use of resin to hold the toroidal concentric ring layers together although optionally resin could be added. The bridging element welded to the toroidal wound magnetic core may be welded to the bridging element prior to machining the air gap, and subsequently annealed in a heat treatment process to ensure optimal and uniform magnetic properties of the core, in particular to eliminate adverse alteration of magnetic properties of the core material during the manufacturing process. The generally flat or planar disposition of the bridging element against a lateral side of the toroidal core provides a particularly compact configuration.

It would be possible within the scope of this invention to provide the magnetic circuit with a pair of bridging elements, one on either lateral side of the magnetic core.

BRIEF DESCRIPTION OF THE DRAWINGS

Further objects and advantageous features of the invention will be apparent from the claims and the following detailed description of an embodiment in conjunction with the annexed figures in which:

DETAILED DESCRIPTION

Figure 1:
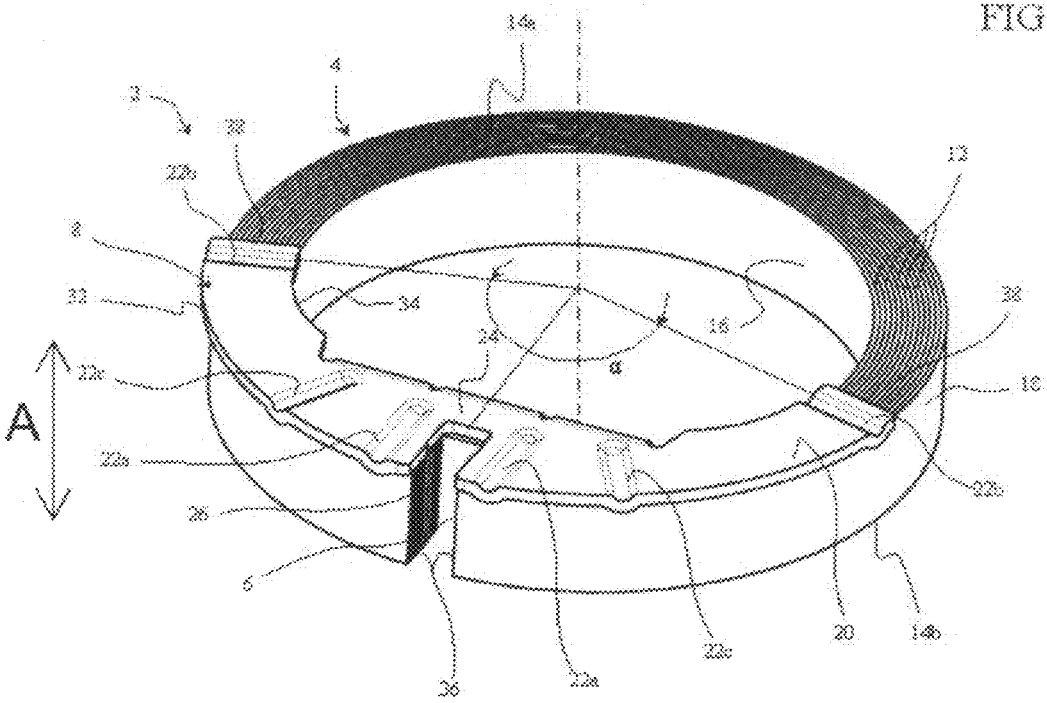
FIG. 1 is a view in perspective of a magnetic circuit according to an embodiment of this invention.
Figure 4:
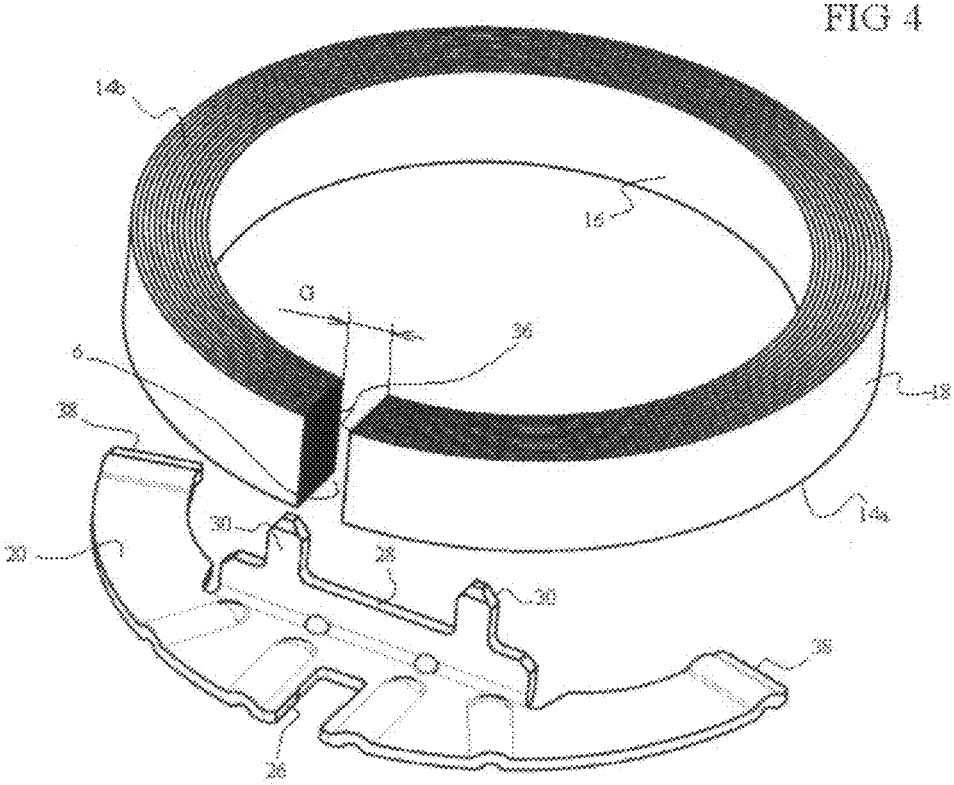
FIG. 4 is an exploded view in perspective of the magnetic circuit shown in FIG. 2.
Figure 3:
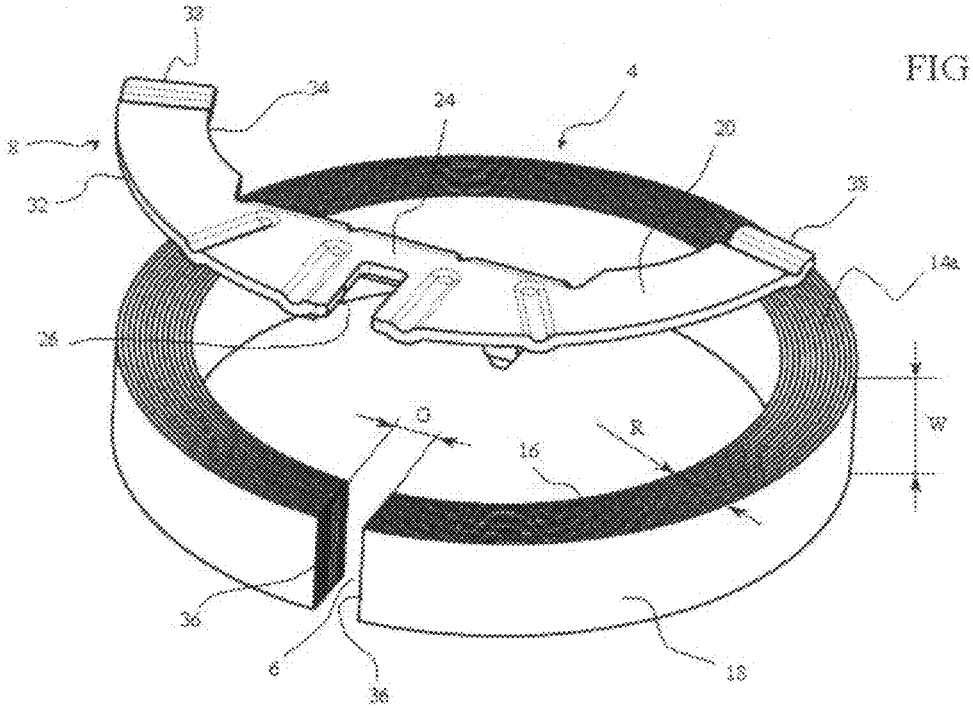
FIG. 3 is an exploded view in perspective of the magnetic circuit shown in FIG. 1.
Figure 2:
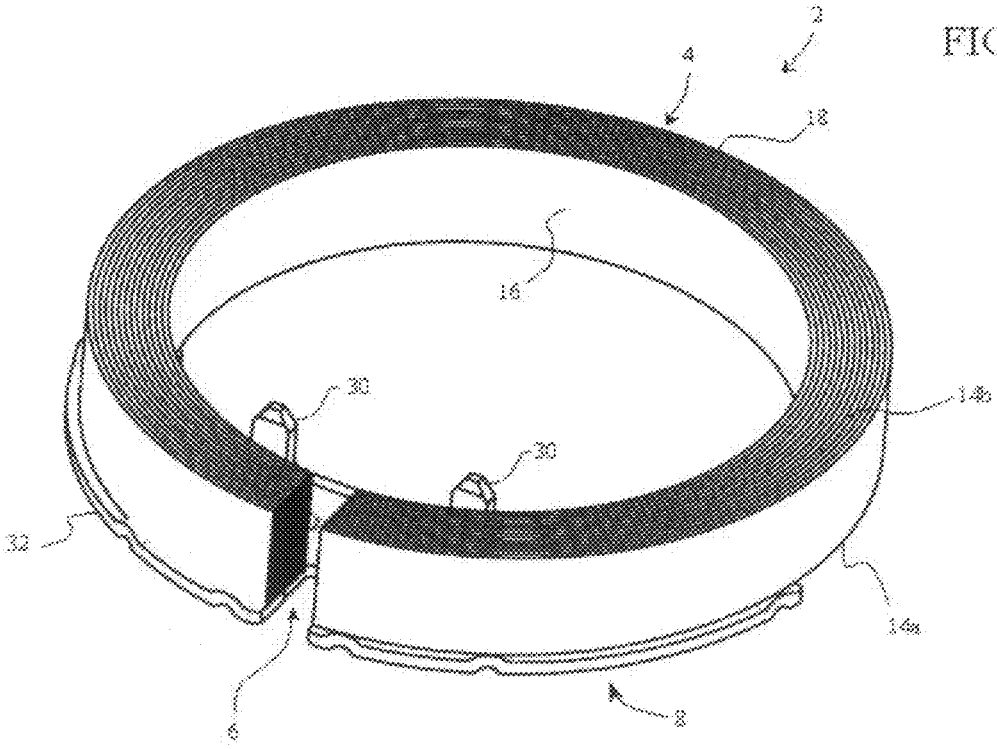
FIG. 2 is a view in perspective of the magnetic circuit shown in FIG. 1 from an opposite side thereof.

Referring to the figures, an embodiment of a magnetic circuit 2, in particular for an electrical current sensing device, comprises an annular magnetic core 4 with a gap 6 (also commonly known as an "air-gap") and a bridge element 8 attached to the magnetic core either side of the gap. The gap 6 is formed between opposed end faces 36 of the magnetic core. The magnetic core 4 is made of a wound strip of thin sheet material with a high magnetic permeability so as to form stacked concentric ring layers, from a radially innermost ring layer 16 to a radially outmost ring layer 18. The thin edges of the strip layer define opposed lateral sides 14*a*, 14*b* of the magnetic core. Magnetic materials with high magnetic permeability are known and for instance include FeSi or FeNi alloys. The bridge element is made of a non-magnetic material, preferably a metal with higher tensile strength than the material of the core, for instance a stainless steel alloy.

The magnetic material strip from which the core is wound has a width W that is preferably of the same order of magnitude as the radial distance R between the innermost and outermost ring layers 16, 18. The ratio of width to radial thickness W/R is preferably in the range of 0.3 to 3, more preferably in the range of 0.5 to 2.

The bridge element 8 is attached to the magnetic core on a lateral side 14*a* of the magnetic core, extending across the magnetic core gap 6. The bridge element comprises a base portion 20 that, in the preferred embodiment, is essentially planar such that it lies essentially flat against the lateral side 14*a*, and has a shape that is generally curved so as to follow the circular shape of the lateral side of the magnetic core. The outermost radial edge 32 extends only by a small amount, preferably corresponding to less than 3 layers of magnetic core strip material beyond the radially outermost and innermost ring layers 18, 16 respectively. The radial extension of the bridge element up to or slightly beyond the inner and outer concentric layers 16, 18 of the magnetic core enables attachment of the bridge element to the magnetic core across all layers. The base portion of the bridge element is attached to the lateral side of the magnetic core by welding connections 22*a*, 22*b*, 22*c*, in other words, by welding of the base portion to the lateral side of the magnetic core whereby the weld connections extend radially across the plurality of ring layers thus ensuring that the stack of layers of magnetic strip material are bounded rigidly and compactly together, preventing separation of the concentric layers in the vicinity of the weld connections. Each weld connection 22*a*, 22*b*, 22*c* preferably extends from a radially innermost ring layer 16 to a radially outermost ring layer 18 of the core. It is however possible within the scope of this invention to have weld connections that traverse a plurality of ring layers less than the entire radial thickness of the core. In the latter variant, separate weld connections are configured to traverse different layers in a manner that the aggregate weld connections traverse all ring layers so as to bind the stacked ring layers from the radially innermost ring layer 16 to the radially outermost ring layer 18.

A first pair of weld connections 22*a* are provided close to the magnetic core gap 6, one either side of the gap. The base portion 20 of the bridge element is provided with a cut-out 26 at the location of the gap and of substantially same length as the length G of the gap in order to allow insertion of a magnetic field detector through and into the gap between opposed end faces 36 of the core 4. It would however be possible within the scope of this invention to not have the cut-out 26 in the base portion of the bridging element whereby the magnetic field detector would be inserted into the gap 6 radially or axially from the opposed lateral side 14*b*. The embodiment illustrated in the figures however allows a magnetic field detector to be positioned on a circuit board (not shown) that extends in an axial direction A through the gap.

The base portion 20 of the bridging element is preferably further attached to the lateral side 14*a* of the magnetic circuit by a second pair of welding connections 22*b*, similar to the first pair 22*a* of welding connections, but positioned close to free ends 38 of the base portion. There may be other intermediate welding connections 22*c* disposed between the welding connections 22*a*, 22*b* arranged at the air gap and at the free end of the base portion. The weld connections 22*a* at the air gap 6 serve to rigidly fix and stabilize the length G of the gap and simultaneously maintain the stacked concentric ring layers of strip material rigidly together, whereas the intermediate weld connections 22*c* and weld connections 22*b* at the ends 38 of the base portion serve to hold the stacked layers of strip material rigidly together and to prevent separation and sliding of the concentric layers when subject to mechanical or thermal stresses. In this regard, the end 38 of the bridge element may advantageously extend, from end-to-end, over an angle $\alpha$ around the periphery of the magnetic core of more than 30°, preferably more than 90°, for instance in the range of 90° to 180°. It is also possible within the scope of this invention to have a bridging element that forms a closed circle and extends over the whole circumference of the core (i.e.)360°, or to extend over any angle between 180° and 360°.

The bridging element may optionally and advantageously further comprise an extension 28. The extension may comprise fixing elements for example in a form of pins or tabs 30 configured to mechanically and/or electrically fix the magnetic circuit to a circuit board or other support to which the magnetic circuit is intended to be mounted. The bridging element may thus advantageously also serve to provide an electrical grounding connection for the magnetic core that may be necessary or useful for its electrical performance. In the embodiment illustrated, the fixing extension 28 is stamped and formed from the same piece of material as the base portion 20 and extends out of the plane of the base portion, in this embodiment orthogonally, towards the opposed lateral side 14*b* such that the fixing pins 30 extend beyond the lateral side 14*b*.

The extension 28 extending out of the plane of the base portion may also or alternatively form a rigidifying element to stiffen the base portion 20 of the bridging element.

It is possible within the scope of this invention to provide an embodiment (not shown) where the fixing extension extends out of the plane of the base portion away from the opposed lateral side 14*b* or alternatively extend in the same plane as the base portion for example radially outwards. The magnetic circuit could thus be mounted against a circuit board or other support on the lateral side 14*a* where the base portion 20 of the bridging element is mounted, or on the opposed lateral side 14*b*, or even mounted standing on the outer peripheral ring layer 18. Other mounting configurations are possible given that the fixing extension may be formed in a wide variety of shapes and sizes and its rigid integral connection to the base portion which is in turn rigidly and solidly attached to the magnetic core ensures secure mechanical fixing of the magnetic circuit to an external support.

In a further variant, it is possible to provide a second bridging element, similar to the first bridging element fixed on the opposed lateral side 14*b* of the magnetic core.

The manufacturing process of the coil described herein includes an operation of winding a strip (band) of high magnetic permeability material, by conventional means for producing wound magnetic cores, and subsequently welding the bridging element 8 (or pair of bridging elements) to a lateral side 14*a* (or lateral sides) of the wound magnetic core. The weld connections may be made by various welding techniques known per se, such as arc welding, resistance welding, friction welding, or laser welding. The term "weld connection" as intended herein also encompasses brazing or solder bonding.

The gap 6 is then machined through a section of the stacked layers of the magnetic core. After the welding operation and the gap machining operation, the magnetic circuit may pass through a heat treatment process for annealing the magnetic material of the core in order to provide it with a uniform magnetic properties, in particular uniform high magnetic permeability. This removes or reduces the adverse effects on magnetic properties of the strip material resulting from the preceding manufacturing operations. The heat treatment process also has the advantageous effect of reducing internal stresses in the magnetic core material.

In the manufacturing process according to the invention, the use of resin to hold the concentric ring layers of strip material may be avoided if desired, which also allows a heat treatment process to be performed on the magnetic circuit at the end of the assembly process.

The invention claimed is:

1. A magnetic circuit comprising at least one gap bridging element made of a non-magnetic metal and a wound magnetic core comprising a plurality of stacked concentric ring layers of magnetic material having a high magnetic permeability, the magnetic core having at least one gap extending through a section of the stacked concentric ring layers of magnetic material, wherein the bridging element is welded to a lateral face of the wound magnetic core on either side of the gap, welding connections between the bridging element and the magnetic core extending across the stacked concentric ring layers.

2. The magnetic circuit according to claim 1 wherein the bridging element comprises a planar base portion lying essentially flat against said lateral face.

3. The magnetic circuit according to claim 2 wherein the bridging element comprises a rigidifying portion extending from the base portion out of the plane of the base portion.

4. The magnetic circuit according to claim 1, wherein the bridging element extends along the core by an angle ($\alpha$) of over 30 degrees.

5. The magnetic circuit according to claim 4, wherein the bridging element extends along the core by an angle ($\alpha$) of over 60 degrees.

6. The magnetic circuit according to claim 5, wherein the bridging element extends along the core by an angle ($\alpha$) of over 90 degrees.

7. The magnetic circuit according to claim 1, wherein the bridging element comprises at least a second pair of weld connections to the stacked ring layers of the magnetic core proximate extremities of the bridging element.

8. The magnetic circuit according to claim 7, wherein the bridging element comprises a third pair or more of intermediate welding connections.

9. The magnetic circuit according to claim 1, wherein the bridging element comprises a fixing element configured for mechanical and/or electrical connection of the magnetic circuit to circuit board or other circuit device.

10. The magnetic circuit according to claim 9, wherein the fixing element comprises fixing pins or tabs bent out of a base portion of the bridging element welded to the lateral face of the magnetic core.

11. The magnetic circuit according to claim 1, wherein the welding connections extend from a radially innermost ring layer to a radially outermost ring layer of the core.

12. The magnetic circuit according to claim 1, wherein the magnetic circuit comprises a second bridging element welded to another lateral face of the wound magnetic core.

13. A method of making a magnetic circuit, including the steps of:

winding a magnetically permeable strip material to form a stacked multilayer ring core;

welding one or more non-magnetic bridging elements to the stacked multilayer ring core wherein the bridging element is welded to one or both lateral face of the wound magnetic core on either side of the gap, welding connections between the bridging element and the magnetic core extending across the stacked concentric ring layers; and machining a gap through a section of the stacked multilayer ring core.

14. The method of making a magnetic circuit according to claim 13 wherein the welding connections extend across the stacked concentric ring layers from a radially innermost ring layer to a radially outermost ring layer.

15. The method of making a magnetic circuit according to claim 13 or 14 further including heat treating the magnetic circuit after the welding and gap machining operation for improving magnetic properties of the core.

* * * * *